US010195763B2

(12) United States Patent
Müller

(10) Patent No.: US 10,195,763 B2
(45) Date of Patent: Feb. 5, 2019

(54) METHOD AND DEVICE FOR MANUFACTURING A CANAL COMPONENT

(71) Applicant: BFS BETONFERTIGTEILESYSTEME GMBH, Blaubeuren (DE)

(72) Inventor: Klaus Müller, Blaubeuren (DE)

(73) Assignee: BFS BETONFERTIGTEILESYSTEME GMBH, Blaubeuren (DE)

( * ) Notice: Subject to any disclaimer, the term of this patent is extended or adjusted under 35 U.S.C. 154(b) by 379 days.

(21) Appl. No.: 14/783,451

(22) PCT Filed: Apr. 14, 2014

(86) PCT No.: PCT/EP2014/057498
§ 371 (c)(1),
(2) Date: Mar. 28, 2016

(87) PCT Pub. No.: WO2014/167135
PCT Pub. Date: Oct. 16, 2014

(65) Prior Publication Data

US 2016/0214275 A1 Jul. 28, 2016

(30) Foreign Application Priority Data

Apr. 12, 2013 (DE) ..... 10 2013 206 616

(51) Int. Cl.
*B28B 11/04* (2006.01)
*B28B 21/94* (2006.01)
(Continued)

(52) U.S. Cl.
CPC ..... *B28B 11/048* (2013.01); *B28B 1/0873* (2013.01); *B28B 1/0935* (2013.01);
(Continued)

(58) Field of Classification Search
CPC ..... B28B 11/048; B28B 1/30; B28B 1/0873; B28B 1/0935; B28B 21/94; E03F 3/04; E03F 5/025
See application file for complete search history.

(56) References Cited

U.S. PATENT DOCUMENTS 6,223,475 B1 5/2001 Hume
2011/0041942 A1* 2/2011 Bartlechner ..... B28B 19/0038 138/111

FOREIGN PATENT DOCUMENTS

DE 69010935 T2 12/1994
DE 102009005354 A1 2/2010
(Continued)

OTHER PUBLICATIONS

EP 2 397 296 Machine Translation of Description.*
(Continued)

*Primary Examiner* — Michael N Orlando
*Assistant Examiner* — Cynthia L Schaller
(74) *Attorney, Agent, or Firm* — Kilpatrick Townsend & Stockton LLP

(57) ABSTRACT

The present invention relates to a method for manufacturing a canal component which comprises a connection portion 104, 106 designed to come into contact with a component 100, in particular an adjacent canal component, which is to be connected to the canal component 100, the method comprising the following steps: providing a concrete base body, coating the base body with a plasticized plastics material 110 in the region of the connection portion 104, 106 and in the region of an internal wall (108) of the base body facing the canal inner space 106, and curing the plastics material (110).

9 Claims, 5 Drawing Sheets

Figure 1A:
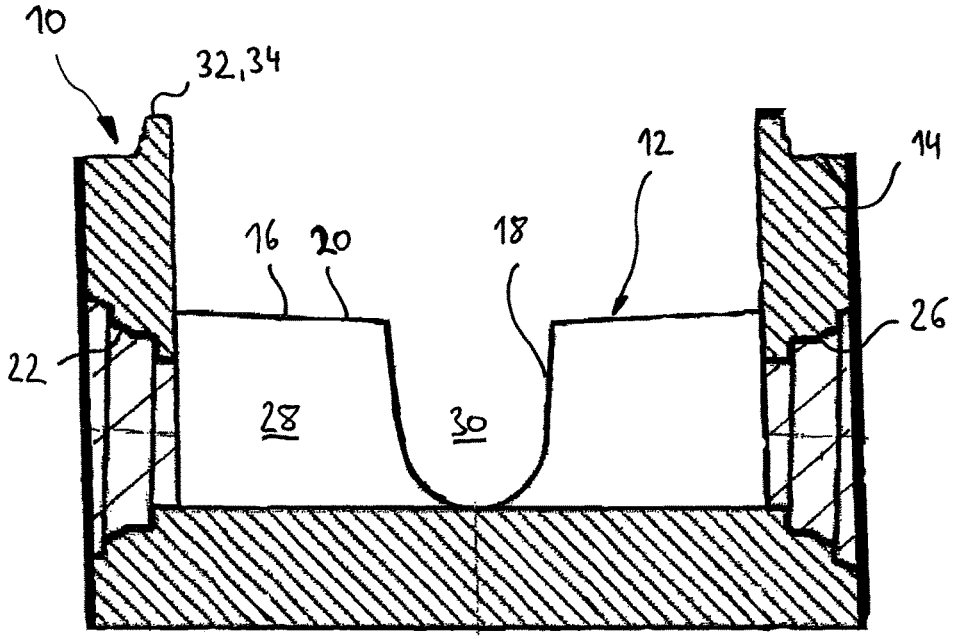

(51) Int. Cl.

| | |
|---|---|
| ***E03F 5/02*** | (2006.01) |
| ***B28B 1/087*** | (2006.01) |
| ***B28B 1/093*** | (2006.01) |
| ***B28B 1/30*** | (2006.01) |
| ***E03F 3/04*** | (2006.01) |

(52) U.S. Cl.
CPC ..... *B28B 1/30* (2013.01); *B28B 21/94* (2013.01); *E03F 3/04* (2013.01); *E03F 5/025* (2013.01)

(56) References Cited

FOREIGN PATENT DOCUMENTS

| | | | |
|---|---|---|---|
| EP | 0386428 | A2 | 9/1990 |
| EP | 0471319 | A2 | 2/1992 |
| EP | 0556533 | A1 | 8/1993 |
| EP | 0913238 | A1 | 5/1999 |
| EP | 1741532 | A2 | 1/2007 |
| EP | 2 397 296 | A2 * | 12/2011 |

OTHER PUBLICATIONS

International Application No. PCT/EP2014/057498, "International Search Report" dated Jul. 11, 2014.
German Application No. 10 2013 206 616.3, "German Search Report", dated Nov. 13, 2014.

* cited by examiner

METHOD AND DEVICE FOR MANUFACTURING A CANAL COMPONENT

PRIOR RELATED APPLICATIONS

This application is a National Phase application of International Application No. PCT/EP2014/057498, filed Apr. 14, 2014, which claims priority to German Application No. 10 2013 206 616.3, filed Apr. 12, 2013, each of which is incorporated herein by reference in its entirety.

The present invention relates to a method for manufacturing a canal component comprising a concrete base body and to a device for manufacturing a canal component of this type.

Canal systems generally comprise wastewater-carrying pipes to be laid underground, in particular in a sewage system. Inspection shafts are provided for maintaining the system, and are constructed from shaft rings arranged above one another, a shaft cone which forms the upper end of the shaft and a lower shaft part which forms the lower end of the shaft. These elements thus also count as canal components within the meaning of the present disclosure, as do other shaft structures, shaft containers and other components which are made of concrete and which may be part of a canal system of this type.

It is known to clad canal components with a plastics material layer so as to prevent direct and permanent action of the water carried in the canal on the concrete and in particular to reduce premature wear of the canal components due to the action of the water and in particular of possible aggressive substances carried in wastewater. Further, a plastics cladding improves the surface quality of the water-carrying regions of the canal components, and this can have a positive effect on the flow properties.

EP 1 880 829 B1 discloses a method for cladding a lower shaft part with a plastics material layer, in which a shaft base, including a desired conduit structure and a berm depression, is produced as a self-supporting structure from a plastics material in a thermoforming process. The shaft base is subsequently introduced into a casting mould to form a lower shaft part and mounted on a mould core of the mould. After demoulding, the shaft base remains in the lower shaft part. A method of this type requires the manufacture of sufficiently stable shaft bases using a relatively high amount of plastics material, to ensure that the shaft base does not deform when the concrete is poured in. Moreover, the thermoforming process requires relatively complex tools, which can only be adapted to an individually desired conduit structure with difficulty.

A further method for manufacturing lower shaft parts having a plastics material cladding is known from EP 1 741 532 B1. In this method, a reusable moulding body is mounted on the mould core of a mould in order to manufacture a lower shaft part. The plastics material layer is applied to the moulding body directly in the mould and cures in the mould. During demoulding, the reusable moulding body likewise remains in the mould, whilst the plastics material layer, together with the lower shaft part, is lifted off the moulding body. A drawback of this method is that the moulded body has to be coated with the plastics material layer inside the mould, and thus also at the site where the lower shaft part is actually manufactured, restricting the flexibility of the process sequence. In particular, if the spatial or climatic conditions are different for applying and curing the plastics material on the one hand and for pouring in and curing the concrete on the other hand, this may lead to complications or additional expenditure of working time in the known method. In addition, the method of EP 1 741 532 B1 results in an increased cycle time, since the mould is inaccessible for producing lower shaft parts during the application of the plastics material and during the curing of the plastics material, and also, if applicable, during the application of a connection layer for improving the bonding between the plastics material and the concrete.

Apart from the above-mentioned drawbacks of process economy in conventional methods, this technical field further has the problem that not only can the liquid itself carried in the canal attack the concrete of the canal components, but also gases which are present in a canal system of this type and are released in particular from wastewater, for example sulfur-containing gases such as hydrogen sulfide, can cause damage to the canal system or can even escape from the canal system into the surrounding ground. Although plastics claddings of the type known in the art can reduce this problem to some extent, the inventors of the present application have found that a considerable proportion of the visible wear found in canal systems is still due to the action or escape of aggressive gases from the canal system.

Against this background, the object of the present invention is to provide a method and a device for manufacturing canal components by means of which canal components can be provided with a plastics material cladding in an effective and cost-effective manner, the method and the device being intended to provide cost savings and a high degree of flexibility. A further object of the present invention is to protect the concrete of the canal components and the surrounding ground as effectively as possible against the action of liquids and gasses which are present in the canal.

In a first aspect, the object of the invention is achieved by a method for manufacturing a canal component which comprises a connection portion designed to come into contact with a component, in particular an adjacent canal component, which is to be connected to the canal component, the method comprising the following steps:

providing a concrete base body, coating the base body with a plasticised plastics material in the region of the connection portion and in the region of an internal wall of the base body facing the canal inner space, and curing the plastics material.

Thus, according to an important feature of the first aspect of the invention, the base body of a canal component is coated with a plastics material not only in the region of the internal wall thereof but also in the region of the connection portion thereof, at which it comes into contact with an adjacent component. In this context, the plastics material is applied to the corresponding parts of the base body in plasticised form, in particular in liquid form, and subsequently cures on the base body. This ensures that the plastics material exactly follows a contour of the base body, in particular in the region of the connection portion, and reliably covers the connection portion. At the contact point between the canal component and a component connected thereto, the contact between the components thus takes place at the plastics material layer (if applicable via a seal arranged therebetween), such that contact between a liquid carried in the canal and the concrete of the base body can be reliably prevented. In this way, the inner space of the canal is further sealed off particularly effectively at the connection portions, in other words the joints with adjacent components, in such a way that gases can also be prevented from escaping from the inner space of the canal and from coming into contact with the concrete of the base body.

Particularly preferably, the entire face, of the base body, facing the canal inner space and all connection portions of the canal component are provided completely and continuously with a continuous plastics material layer; in other words the plasticised plastics material is applied without gaps to all faces and regions which either face the canal inner space or can come into contact with adjacent components which are to be to connected to the canal component.

A preferred embodiment of the invention provides that the connection portion is formed

- as a receiving portion comprising a portion having an expanded diameter or a recess, such that the receiving portion is designed to receive a connection portion of an adjacent component therein, or
- as an end portion comprising a portion having a tapered diameter or a projection, such that the end portion is designed to be inserted into a connection portion of an adjacent component. The formation of the connection portion as a receiving portion or end portion makes it possible to connect adjacent components by partially inserting the components into one another, making it possible to achieve a stable, well-sealed connection between the components. Since according to the invention the connection portions are covered with the plastics material layer, effective sealing can be provided over the periphery of a relatively large sealing area here.

Preferably, the canal component comprises a receiving portion at one axial end and comprises an end portion at the opposing axial end such that the canal component can be received between two adjacent canal components as part of a continuous canal. If the receiving portion, the end portion and the entire internal wall of the canal component are all covered with the plastics material layer, substantially the entire canal, including the joints, can be reliably sealed.

A seal may be mounted on the connection portion and lies on the plastics material so as to overlap the plastics material at least in part such that a liquid-tight and gas-tight contact connection between the plastics material claddings of adjacent canal components can be achieved.

The base body which is used in the method according to the invention can be manufactured in a casting process which takes place beforehand and which comprises the following steps: pouring concrete into a mould, at least partially curing or compacting the concrete and demoulding the base body at least in a region of the internal wall and of the connection portion.

In a preferred embodiment of the invention, the plasticised plastics material is dispensed from a rotating nozzle. By means of a nozzle of this type, in particular a circular cylindrical internal wall of a canal component, in particular of a shaft ring, a shaft cone or a pipe, can be coated particularly effectively and uniformly. The rotating nozzle can be arranged so as to be movable along a central axial axis of the canal component so as to coat an internal wall of the canal component substantially over the entire axial length. Preferably, the nozzle or a further application device also coats the at least one connection portion.

In a second aspect, the aforementioned object of the invention is achieved by a method for manufacturing a concrete lower shaft part, comprising the following steps,

- providing a new, at least partially cured or compacted concrete base body, the base body comprising a shaft base, preferably comprising a conduit,
- coating the base body with a plasticised plastics material at least in a region of the shaft base,
- curing the plastics material.

According to the method of the second aspect, a new base body is covered with a plastics material at least in the region of the shaft base thereof before being laid in the ground. Coating the lower shaft part during the manufacturing process has the advantage that damage to the concrete due to the action of a liquid carried in the canal can be effectively counteracted from the outset and moreover the individual points in the base body are significantly easier for the coating device to access than if a base body which has already been set in operation and laid in the ground and which is installed in a canal system is retroactively cladded with a plastics material. In particular, the method according to the second aspect thus also makes it possible to cover connection portions of the lower shaft part in such a way that contact faces with adjacent components, which are completely inaccessible once the lower shaft part has been laid, can also be covered with the plastics material, and very good sealing is thus possible in particular in the region of the connection portion.

According to a third aspect of the present invention, the aforementioned object of the invention is achieved by a method for manufacturing a concrete canal component, comprising the following steps:

- providing an inner mould which forms an internal contour, of the canal component, facing the canal inner space,
- coating the inner mould with a plasticised plastics material,
- curing the plastics material to form a solid plastics material layer,
- arranging the inner mould, along with the solid plastics material layer, and a mould shell which forms an external contour of the canal component, in such a way that the mould shell encloses the inner mould,
- pouring concrete in between the inner mould and the mould shell,
- at least partially curing or compacting the concrete,
- demoulding the canal component.

In the third aspect of the invention, the plastics material is not applied to a prefabricated base body of the canal component, but rather to a portion of a mould for manufacturing the canal component in a plasticised form. The plastics material layer is applied to the inner mould, where it cures. Only when the canal component is demoulded is the inner mould separated from the plastics material layer such that the plastics material layer remains on the canal component and forms the plastics material cladding of the canal component. In the third aspect, the plastics material layer is manufactured on the inner mould outside the mould shell, and only after the plastics material layer cures is the inner mould, along with the plastics material layer formed thereon, inserted into a mould shell of a mould for manufacturing the canal component. This means that the plastics material layer can be prefabricated in a separate, upstream work step, and in particular can also be manufactured in a workspace suitable for applying and curing the plastics material layer. Subsequently, the inner mould, along with the plastics material layer, is guided to the mould shell, and in a second workstation, optionally under different work conditions or climatic conditions, the canal component can be cast between the mould shell and the plastics material layer. In this way, the method according to the third aspect of the invention also makes it possible to manufacture and cure the plastics material layer at the same time on an inner mould, on the one hand, and simultaneously to manufacture a lower shaft part by pouring in and curing concrete between a mould shell and a second inner mould comprising an already cured plastics material layer on the other hand. In this way, the method for manufacturing a canal component according to the third aspect of the invention can run particularly effectively.

In a preferred embodiment of the method according to the third aspect, the canal component may be a lower shaft part comprising a conduit and the inner mould may comprise a conduit moulding body consisting of a foamed plastics material, in particular expanded polystyrene, or of a plaster material, which forms the conduit. The use of a foamed plastics material makes possible simple, cost-effective manufacture of a conduit moulding body having any desired individual conduit geometry, for example in that the conduit moulding body is manufactured from a foamed plastics material pipe body by a milling process. In addition, a conduit moulding body made of foamed plastics material has a relatively low weight, and this is highly advantageous in particular in the method according to the third aspect, since the conduit moulding body, along with the plastics material layer formed and cured thereon, can be handled more effectively separately from the mould. In particular, this reduces the technological complexity required to transport the conduit moulding body from a first processing station, where the conduit moulding body is covered with the plastics material layer and the plastics material layer is left to cure, to a second processing station, in which the conduit moulding body is inserted into the mould and the concrete is poured into the mould. Comparable advantages occur if plaster is used for the conduit moulding body.

The inventors have moreover found that a conduit moulding body consisting of foamed plastics material and covered with a plastics material layer has sufficient dimensional stability even if relatively thin plastics material layers are used, and therefore deformations of the conduit moulding body are substantially ruled out when the concrete is poured in. In particular, the foamed plastics material provides considerable stabilisation and support by comparison with the self-supporting shaft bases made of thermoformed plastics material which are known in the art.

In a fourth aspect, the aforementioned object of the invention is achieved by a method for manufacturing a canal component in the form of a shaft ring, a shaft cone or a pipe, comprising the following steps:

- providing an inner mould which forms an internal contour, of the canal component, facing the canal inner space,
- coating the inner mould with a plasticised plastics material,
- curing the plastics material to form a solid plastics material layer,
- providing a mould shell which forms an external contour of the canal component,
- pouring concrete in between the inner mould and the mould casing,
- at least partially curing or compacting the concrete,
- demoulding the canal component.

The method according to the fourth aspect also includes applying a plastics material coating to an inner mould as an essential characterising feature, the plastics material being applied in a plasticised form and curing on the inner mould. After a canal component manufactured in this way has demoulded and the plastics material layer has separated from the inner mould, a plastics material cladding having a particularly high surface quality is obtained. Further, a method of this type may achieve the advantages and effects previously described in connection with the third aspect, in particular if the inner mould is coated with the plastics material outside the mould shell in a separate work step.

In a method according to the third or fourth aspect of the invention, the canal component may comprise a connection portion designed to come into contact with a component, in particular an adjacent canal component, which is to be connected to the canal component, a portion, of the inner mould, which forms the connection portion or a mould sleeve which forms the connection portion also being coated with plasticised plastics material. As a result of this measure, the canal component may also be reliably cladded with a plastics material in the region of a connection portion in such a way that the contact points between the canal component and an adjacent component are also covered by plastics material and, in these regions, neither liquid nor gases can escape from the canal or come into contact with the concrete of the canal component.

Preferably, a seal is placed on the portion of the inner mould forming the connection portion or on the mould sleeve, the plasticised plastics material being applied in such a way that it overlaps or covers the seal. As a result of the plastics material overlapping or covering the seal, a particularly liquid-tight or gas-tight connection can be created over a relatively large area.

In methods according to the third and/or fourth aspects of the invention, it is further conceivable for bonding courses in the form of grit, sand, granulate, anchoring projections or in the form of a lattice to be either applied to or introduced into the plastics material in such a way that when the canal component is cast, the bonding courses come into contact with the concrete and if applicable partially penetrate into the concrete. In this way, stronger bonding is ensured between the plastics material and the concrete of the canal component in such a way that on the one hand it can be ensured that, when the canal component demoulds, the plastics material remains on the canal component, and on the other hand the advantage is achieved that the plastics material is not released from the concrete even after a long service life of the canal component in the ground.

Plastics materials known per se, preferably thermosetting or plasticisable, may be used as the plastics material, for example a polyethylene (PE) or a polypropylene (PP). It is particularly advantageous to use a polyurea as the plastics material. The inventors have found that this material on the one hand ensures good adhesion to the concrete of the canal component and on the other hand has good processing properties for applying the plastics material in plasticised or liquid form. In addition, the cured polyurea inliner layer has high long-term stability and resistance to chemicals carried in wastewater.

In the method according to the above-disclosed aspects one to four of the invention, it is conceivable to apply the plastics material by centrifuging or spraying. Coating methods of this type make effective and particularly uniform coating possible at a largely constant layer thickness.

Preferably, the at least one connection portion of the canal component is further coated with the plastics material using a second application apparatus (or in a separate work step using the same nozzle).

To achieve maximum flexibility and precision at the same time when coating the base body or a moulded part with a plastics material layer, in a further preferred embodiment of the invention the plastics material may be applied by a robot arrangement which moves along a surface of the canal component or inner mould in accordance with geometric data regarding the canal component or inner mould and thus applies the plastics material. A particular synergistic effect can be achieved if an inner mould having a desired contour is previously manufactured by means of a robot-controlled shaping process, for example a milling process, and a robot arrangement used for manufacturing an inner mould can likewise be used to apply the plastics material layer to the inner mould, for example by exchanging a tool held by a robot arm.

In a fifth aspect of the present invention, the aforementioned object is achieved by a device for manufacturing a concrete canal component which has at least one connection portion in the form of an opening which is defined by a peripheral opening rim, the canal component defining a canal which passes through the opening so as to continue in a component, in particular an adjacent canal component, to be connected to the canal component, said device comprising a mould which has a first mould portion for forming a wall portion of the canal component and a second mould portion for forming the connection portion, the mould comprising a plastics material layer which covers both the first mould portion and the second mould portion, the plastics material layer being formed on the second mould portion in such a way that it encloses the opening rim at least in part in a direction transverse to the direction of extension of the opening rim.

In particular by the use of a method according to the third and/or fourth aspect of the invention, a device of this type is suitable for manufacturing a concrete canal component which is reliably covered by a plastics material layer both on a wall portion and in the region of a connection portion, the plastics material layer in particular also extending on the opening rim of the opening to such an extent that a component connected to the opening does not touch the concrete of the canal component but rather merely comes into contact with the plastics material layer or with a seal optionally arranged on the connection portion. The device thus makes it possible to manufacture a canal component which can be integrated into a canal structure comprising other components in such a way that the resulting canal is reliably sealed even in the region of the connection points between adjacent components and the escape of liquid or gases from the canal and contact between liquids or gases and the concrete of the canal components can be prevented.

In a preferred embodiment of the device according to the fifth aspect of the invention, the second mould portion may have a U-shaped or an L-shaped cross section. In this way, a connection portion of the canal component may be encased or enclosed either in part or completely by a plastics material layer so as to effectively seal the canal in the region of the connection portion using a simple moulding geometry. A U-shaped or L-shaped cross section can be coated with plasticised plastics material in a simple manner in a coating method.

The first mould portion and the second mould portion may be formed on separate mould elements which are joined together in such a way that the plastics material layers of the two mould portions contact one another and/or are interconnected by a seal or an adhesive connection. This measure can facilitate coating of the two mould portions, for example if a spraying device can be positioned more flexibly. If a concrete pipe is being manufactured, the first mould portion may be a cylindrical inner mould and the second mould portion may be a mould sleeve which can be placed on an axial end of the inner mould.

In a further embodiment of the invention, it is conceivable for the second mould portion to comprise a seal which is overlapped by the plastics material layer either in part or completely such that a relatively large contact area is provided between the plastics material and the seal so as to further improve sealing.

In particular, the device may be designed to manufacture a canal component of which the connection portion is formed as a receiving portion or end portion in the configuration described above in relation to the first aspect of the invention. A device according to the fifth aspect may then have a shape which forms a receiving portion at one axial end and forms an end portion at an opposing axial end, the plastics material layer preferably having an L-shaped cross section at the end forming the receiving portion and/or the plastics material layer preferably having a U-shaped cross section at the end forming the end portion.

Figure 1B:
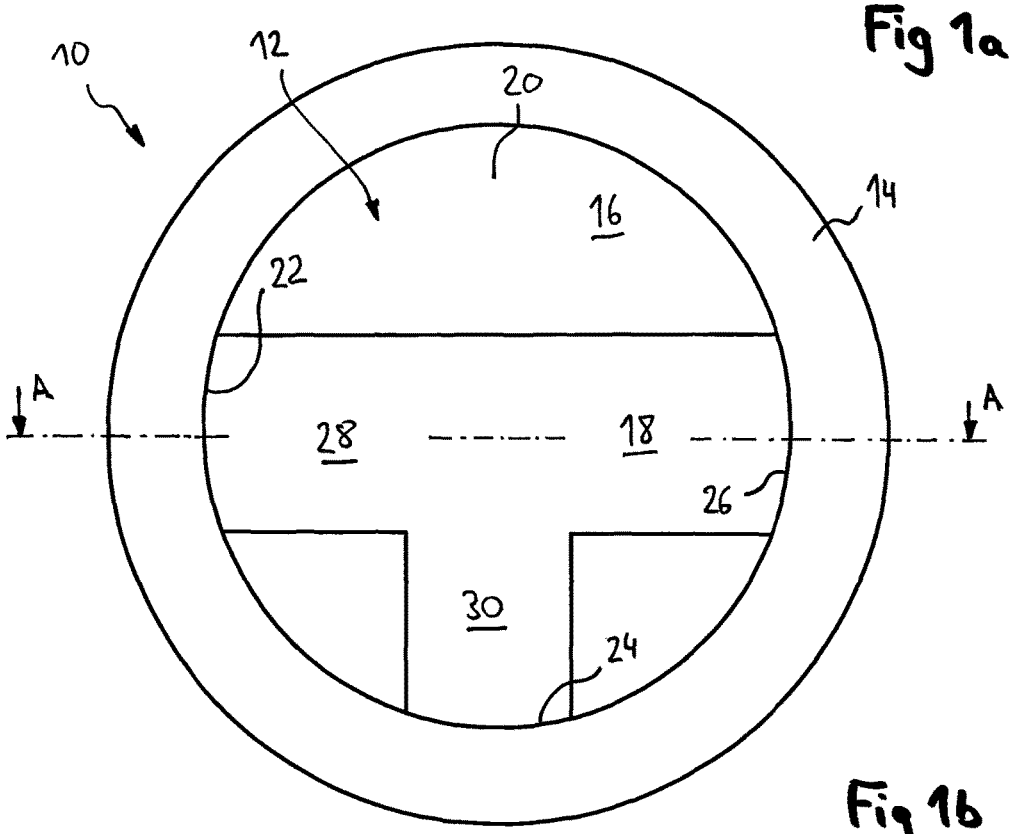
Figure 2:
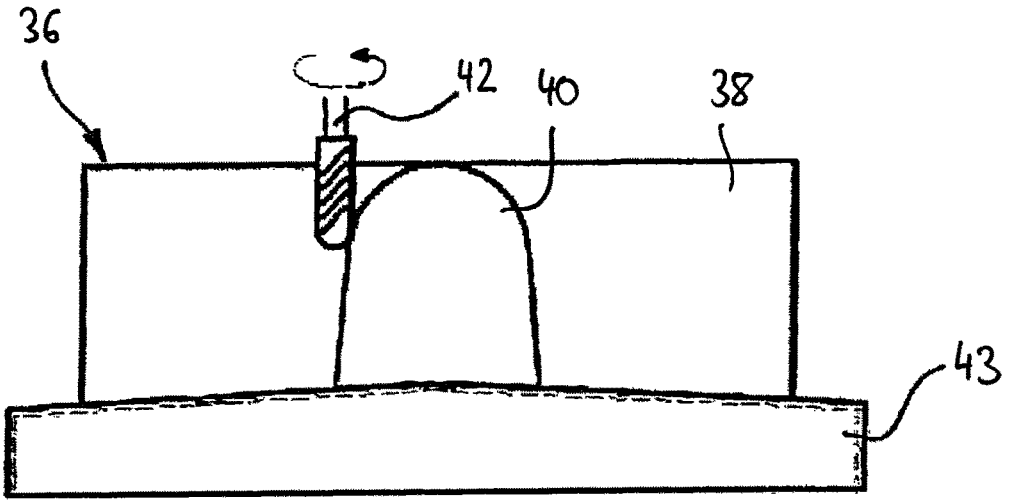
Figure 3:
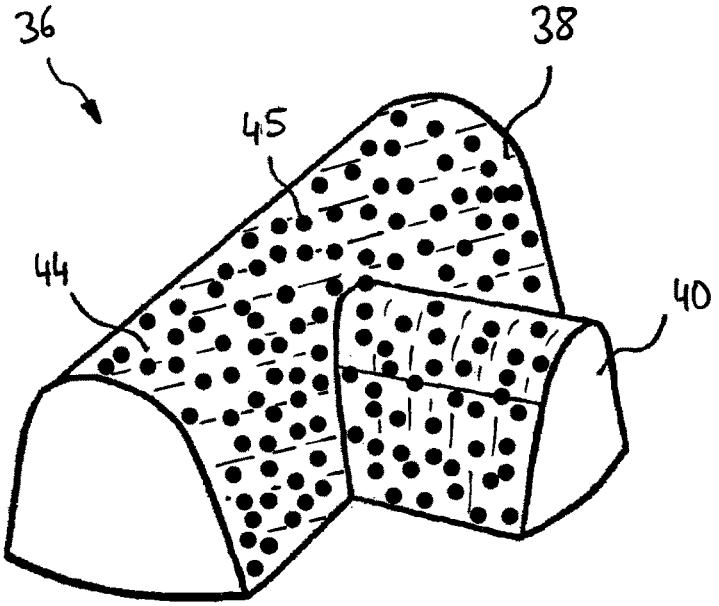
Figure 4:
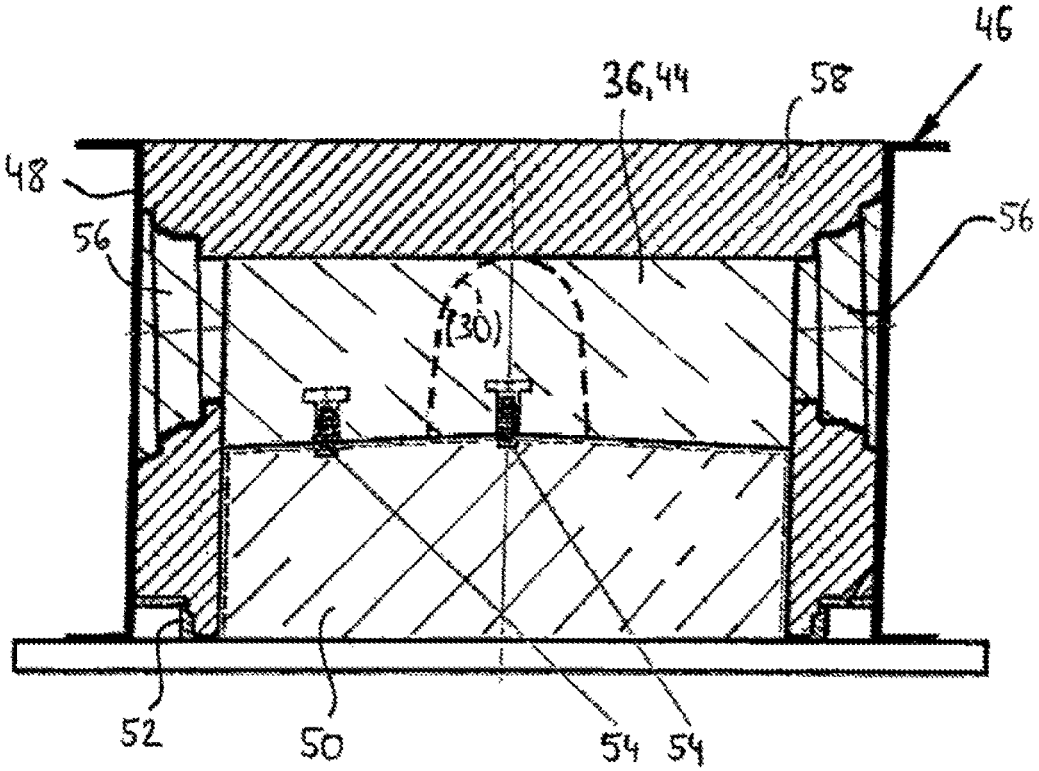
Figure 5:
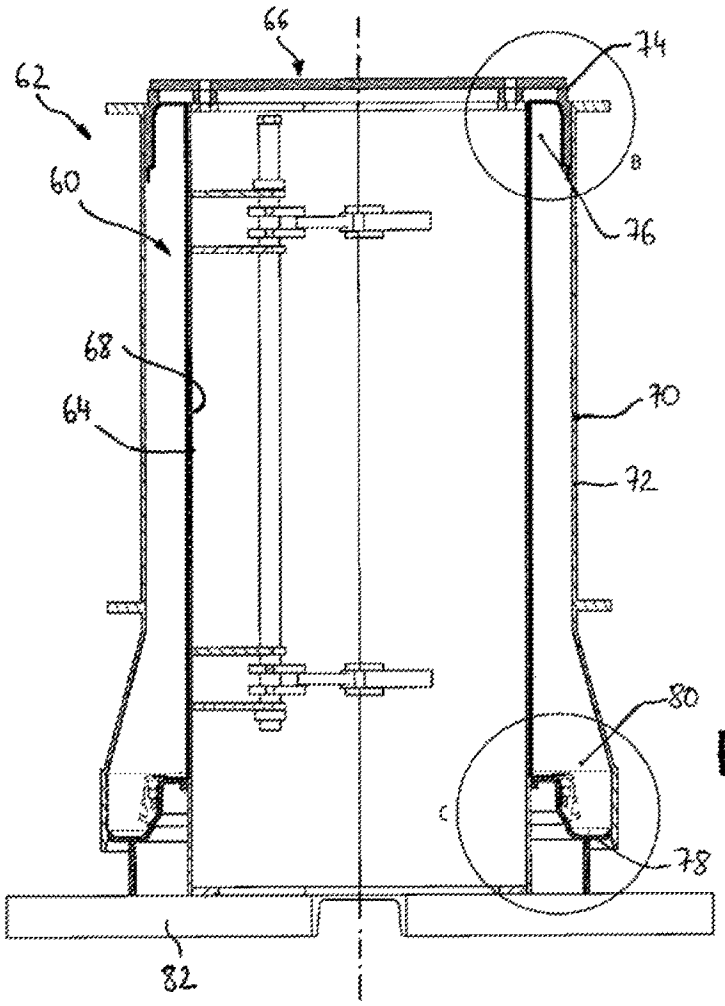
Figure 6:
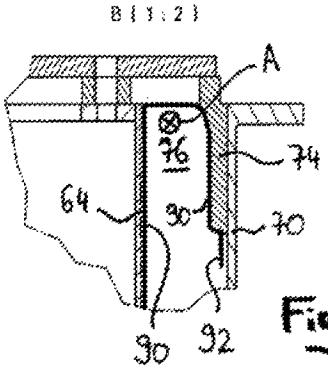
Figure 7:
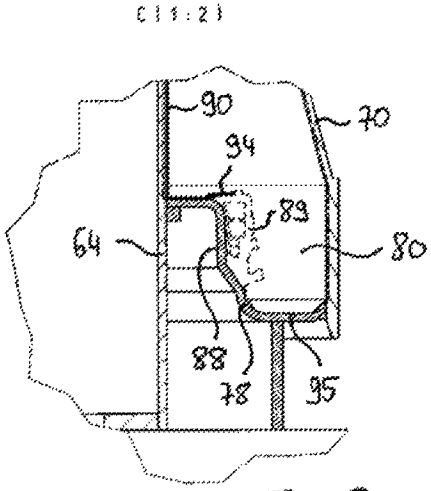
Figures 8, 9, 10:
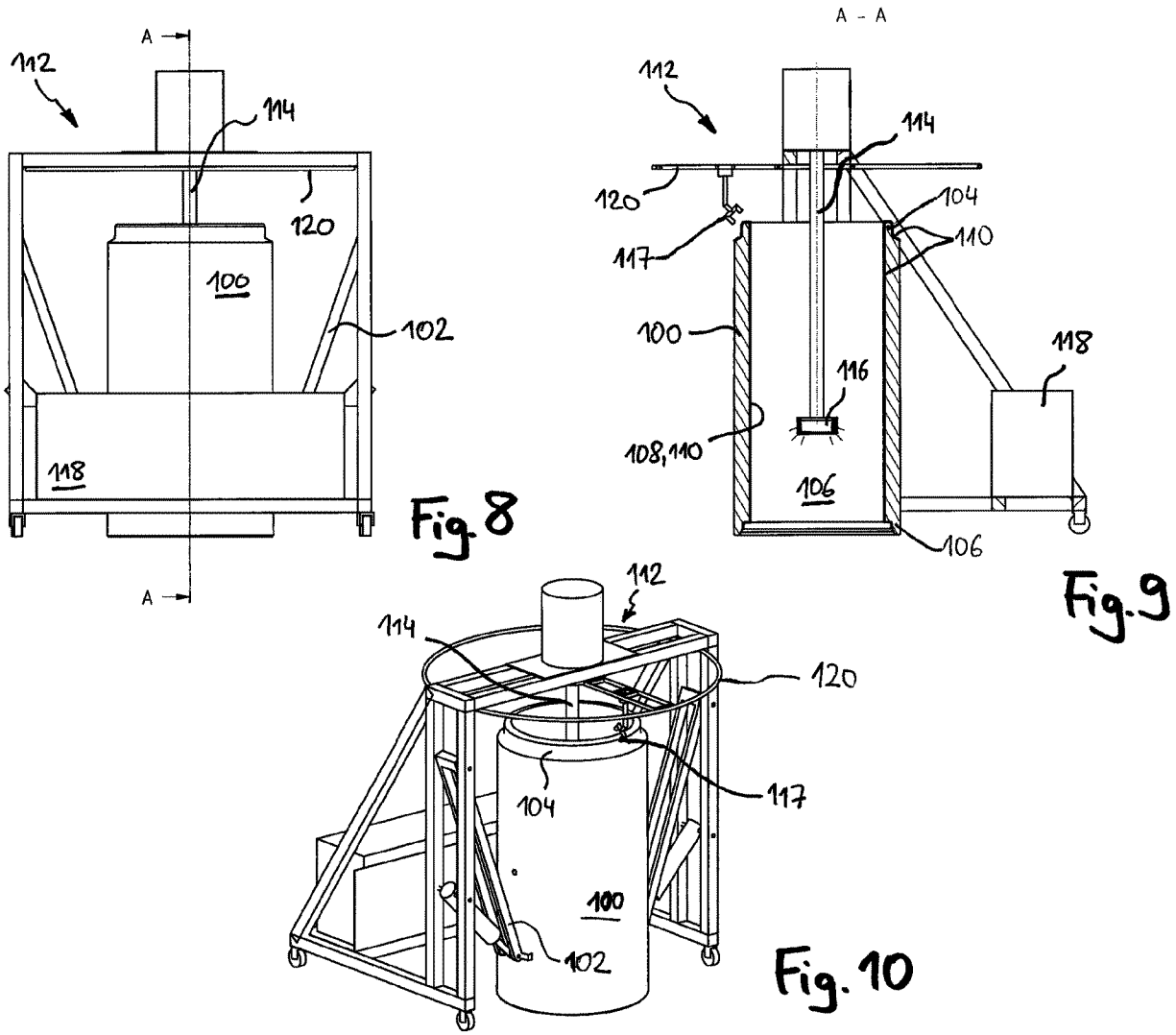

In the following, the invention is described in greater detail by way of preferred embodiments with reference to the accompanying drawings, in which:

FIGS. 1*a* and 1*b* are a plan view and a sectional view, along a section line A-A in FIG. 1*b*, of a concrete lower shaft part manufactured according to a method according to a first embodiment of the invention, FIG. 2 is a side view of a conduit moulding body during a first step of the method according to the first embodiment of the invention, FIG. 3 is a perspective view of the conduit moulding body during a further step of the method according to the first embodiment, FIG. 4 shows a mould for manufacturing the lower shaft part shown in FIG. 1 during a third step of the method according to the first embodiment, FIG. 5 is a cross-sectional view of a manufacturing device to illustrate a device and a method according to a second embodiment of the invention, FIG. 6 is an enlarged detail of a detail marked B in FIG. 5, FIG. 7 is an enlarged detail of a detail marked C in FIG. 5, FIG. 8 is a side view of a manufacturing device to illustrate a device and a method according to a third embodiment of the invention, FIG. 9 is a sectional view along a section line A-A in FIG. 8, and FIG. 10 is a perspective view of the manufacturing device shown in FIG. 8.

FIG. 1 shows a lower shaft part 10 according to the first embodiment of the invention, comprising a cylindrical shaft wall 14 which encloses a canal 12 and a base portion 16 which forms the base of the canal 12. A conduit 18 and in most cases a berm portion 20 comprising a berm falling away towards the conduit 18 are formed in the base portion 16. At the shaft wall 14, the conduit 18 opens into pipe connections 22, 24, 26 to which adjacent components, in particular concrete pipes, are to be connected. Depending on the desired number and position of the pipe connections 22, 24, 26 and on other requirements of the lower shaft part 10, the conduit 18 may comprise different structures having a different number of conduit branches, extension paths, angles of inclination, etc. In the present embodiment, a primary conduit branch 28 extends between the pipe connections 22 and 24, a subsidiary conduit branch 30, which leads to the pipe connection 26, branching off at a central position of the primary conduit branch 28.

At an upper peripheral edge of the shaft wall 14, which wall extends around the duct 12, the lower shaft part 12 is formed as a first connection portion 32 which is designed to couple to a component positioned thereabove in a fitting manner, in most cases a shaft ring positioned thereabove. In the embodiment, an annular projection 34 is provided on the first connection portion 32 and can engage in a fitting manner in a corresponding annular recess of a component positioned thereabove. Further connection portions are provided on the pipe connections 22, 24, 26 and designed to receive pipes or the like, which are to be connected thereto, in a fitting manner.

According to the method of the first embodiment, to manufacture a lower shaft part 10 according to FIG. 1, a conduit moulding body 36 can be manufactured in a first method step and forms the conduit 18 of the subsequent lower shaft part 10, in other words forms a geometric negative of the conduit 18. In the embodiment, the conduit moulding body 36 accordingly comprises a primary portion 38 for forming the primary conduit branch 28 and a subsidiary portion 40 for forming the subsidiary conduit branch 30. If desired, the conduit moulding body 36 may also form at least part of the berm portion 20.

The conduit moulding body 36 is preferably made of a plastics material, in particular a foamed plastics material (for example expanded polystyrene), such that it is easy to process, is simple to handle, and additionally, because of the low costs thereof, can also effectively be designed as a disposable moulding body for single use and subsequent destruction. To provide a desired shape of the conduit moulding body 36 corresponding to a conduit 18 to be formed, the conduit moulding body 36 may preferably be adapted to the desired shape using a milling tool 42. The milling tool 42 may be controlled in an automated manner, for example by a robot on the basis of three-dimensional measurement data regarding the desired conduit 18. In particular, it is possible to use a method for manufacturing a moulding body 36, as described in EP 2 318 625, the relevant content of which is to be incorporated into the present disclosure by reference.

In a subsequent method step, a separating medium known per se, for example an oil-based or wax-based separating medium, may be applied to the conduit moulding body 36.

Subsequently, the surface of the conduit moulding body 36 which will subsequently face the concrete is coated with a layer 44 made of plasticised plastics material. In particular polyurea, an epoxy resin, polyethylene, polypropylene or other thermosets are conceivable as the material. Particularly preferably, a polyurea is used. The plastics material 44 may be applied in a liquid or spreadable form, and, prior to or directly during the application, can be mixed with a curing agent which can accelerate curing of the plastics material after application. A spraying method may be used in which the plastics material is thrown out through a nozzle using pressurised air. Alternatively, the plastics material can be applied to the surface of the conduit moulding body using a paintbrush or a roller.

Advantageously, the tool for applying the plastics material layer 44 may be guided along on the surface of the conduit moulding body 36 in an automated manner, or a blast direction of a spray tool may be controlled in an automated manner in accordance with the contour of the conduit moulding body 36. The automated tool guidance may in particular be carried out by a robot. The robot may operate analogously to the robot which is optionally used for milling the conduit moulding body 36, and with a particular synergistic effect may even be the same robot.

The plastics material layer 44 may be provided with bonding courses 45. For this purpose, grit, sand, granulate or the like may be attached to (for example sprayed onto) the plastics material layer 44 or integrated into the plastics material layer. Optionally, these materials may also already be contained in the plasticised plastics material during the application of the plastics material layer 44, or the bonding courses may be introduced into the plastics material when it has not yet completely cured. Alternatively or in addition, anchoring projections may be placed on and attached to the plastics material layer 44 as bonding courses, or the plastics material layer 44 is covered with a lattice or mesh. The bonding courses 45 serve to improve the adhesion between the plastics material layer 44 and the concrete.

After the plastics material layer 44 has been applied, it cures on the conduit moulding body 36.

In a subsequent method step of the method of the first embodiment, the conduit moulding body 36, including the plastics material layer 44 cured thereon, is guided to a mould 46 in which a lower shaft part 10 is to be produced. In a manner known per se, the mould 46 comprises a cylindrical mould shell 48 which is designed to form an external wall of the lower shaft part 10, a mould core 50 which is arranged coaxially in the mould shell 48 and is of a substantially cylindrical shape, for forming an internal wall of the lower shaft part 10, and a mould sleeve 52, which is arranged annularly in a gap between the mould shell 48 and the mould core 50, for forming the peripheral edge comprising the first connection portion 32, optionally including the annular projection 34, of the lower shaft part 10.

The conduit moulding body 36 is placed on the mould core 50, where it is preferably fixed against slipping or floating by means of fastening means 54, for example screws. Subsequently, recess cores 56, which are intended to form the pipe connections 22, 24, 26 and are preferably likewise manufactured from a foamed plastics material in a milling process, are placed on and likewise attached to the conduit moulding body 36.

Alternatively, the recess cores 56 may already be attached to the conduit moulding body 36 before the plastics material layer is applied, or may even be formed in one piece with the conduit moulding body 36. In a variant of the invention of this type, the recess cores 56 (which can in this case be considered part of the conduit moulding body 36) are subsequently also likewise covered with the plastics material layer 44 before being introduced into the mould 46, in other words prepared in the same manner described above for the conduit moulding body 36 (optionally including separating medium application and/or bonding course attachment). It is also possible for the conduit moulding body 36 and the recess cores 54 to be provided as an integral moulding body (for example manufactured from a foamed plastics material by the above-described milling method) and for this moulding body to be coated with a plastics material layer in an upstream method step in the above-described manner. If the recess cores 54 are attached to or formed on the conduit moulding body 36 before the application of the plastics material layer in the above-described variants, and if the plastics material layer is subsequently applied over the conduit mould 36 and the recess cores 54 in a continuous and joint-free manner, it can be provided that substantially the entire conduit 18, including the pipe connections 22, 24, 26, can be provided with a plastics material cladding both continuously and homogeneously.

In a subsequent method step of the method according to the first aspect of the invention, concrete 58 is poured into the mould 46 in such a way that it is distributed in the space between the mould shell 48 and the mould core 50 or conduit moulding body 36. In this case, the lower shaft part 10 can actually be manufactured in a production process known per se, in particular in a direct demoulding process or a mould-setting process. In a direct demoulding process, at least one vibration apparatus is arranged on the mould 46, for example integrated in the mould core 50, positioned on the mould shell 48, or the mould 46 is placed on a vibrating table. During or after pouring in the concrete, the vibration apparatus is set in operation in such a way that the poured-in concrete is compacted and gains sufficient stability for the lower shaft part 10 to be able to demould. Subsequently, the concrete is actually cured outside the mould 46, or at least with the mould shell 48 removed. In a mould-setting process, it is not necessary to provide vibration apparatuses. In this case, the poured-in concrete is kept in the mould 46 until it has at least partially cured and demoulding is reliably possible.

In the demoulding process, the mould shell 48 may first be opened, and subsequently the lower shaft part can be moved away from the mould core 50. Preferably, in this context the attachment 54 between the conduit moulding body 36 and the moulding body 50 is released so that when the lower shaft part 10 is lifted off, the conduit moulding body 36 initially remains on the lower shaft part 10. In a subsequent method step, the conduit moulding body 36 can subsequently be released from the plastics material layer 44. Releasing the conduit moulding body 36 from the plastics material layer 44 thereof is facilitated by the optionally applied separating medium. However, in particular if foamed plastics material (expanded polystyrene) is used as the material for the core of the conduit moulding body 36, it should be anticipated that when the foamed plastics material is removed, the material may get damaged or destroyed. Conduit moulding bodies made of foamed plastics material can advantageously be used as disposable conduit moulding bodies.

After demoulding, a lower shaft part 10 is obtained, the conduit of which and preferably also the connection portions of which are cladded with a plastics material to a high surface quality and with effective sealing.

In the following, a second embodiment of the invention is described with reference to FIG. 5 to 7.

In the embodiment, a device for manufacturing a canal component 60, in this case a concrete pipe, is a mould 62 which comprises: a mould core 64, which forms an inner face 68, of the canal component 60, facing a canal 66, a mould shell 70, which forms an outer face 72 of the canal component 60, a first sleeve 74, which forms a first connection portion 76 at the rim of a first opening of the canal component 60, and a second sleeve 78, which forms a second connection portion 80 of the canal component 60 at the rim of a second opening. The mould core 64, the mould shell 70, the first sleeve 74 and the second sleeve 78 enclose a mould cavity, in which the canal component 60 is manufactured. The mould 62 may be arranged on a table 82.

The connection portions 76 and 80 of the canal component 60 comprise such contours that they are designed to receive an adjacent component in a fitting manner, in particular a canal component connected thereto, so as to form a continuous canal 66. In the embodiment, the first connection portion 76 is formed as an end portion having a portion 84 of tapered diameter (tapering of the external diameter of the canal component 60), and the second connection portion 80 is formed as a receiving portion having a portion 86 of expanded diameter (expanded internal diameter of the canal component 60). As can be seen in FIG. 5 to 7, the first connection portion 76 also forms an annular projection and the second connection portion 80 is provided with a matching recess 88.

The first and second connection portion 76, 80 of the canal component 60 may in particular be designed in such a way that a first connection portion 76 of a canal component 60 can be inserted into a second connection portion 80 of an adjacent canal component 60, in that in particular the annular projection 76 engages in the recess 88. At the connection portions 76, 80, adjacent canal components 60 touch one another. In a manner known per se, in the region of the connection portions 76, 80 (in the embodiment at the second connection portion 80 in the region of the recess 88), a seal 89 in the form of an annular seal may be inserted, which further improves the seal between the canal components at the transition between the canal components.

For providing the plastics material cladding of the canal component 60, the mould core 64 carries a plastics material layer 90. In a first method step of the method according to the second embodiment, the plastics material layer 90 may be applied to the mould core 64 in a plasticised form. A face, of the first and/or second mould sleeve 74, 78, facing the canal component 60 may also be covered with the plastics material layer 90 so as also to provide the first connection portion 76 or the second connection portion 80 with a plastics material layer. For the description of the preferred plastics materials and the techniques for applying the plastics material in a plasticised form, reference is made to the description of the first embodiment. Particularly preferably, in the second embodiment too liquid polyurea is applied by a spray method from a nozzle which is automatically controlled.

The first sleeve 74 and/or the second sleeve 78 may be formed integrally on the mould core 64. When the plastics material layer 90 is applied, the sleeve 74 or 78 and the mould core 64 are preferably coated continuously, ensuring a reliable, continuous plastics material layer. However, it may be advantageous to form the first sleeve 74 and/or the second sleeve 78 as a separate moulding which can be released from the mould core 64 or can be mounted on the mould core 64. The first or second sleeve 74, 78 can subsequently be suitably positioned so as to be able to apply the plastics material layer 90 reliably and accurately without the mould core 64 obstructing the positioning of an application tool. If a separate first and/or second sleeve 74, 78 is/are used, a tight connection between the plastics material layer of the sleeve 74, 78 and the plastics material layer 90 of the mould core 64 should be established after the sleeve 74, 78 is mounted on the mould core 64. This can be provided by way of an adhesive connection or by subsequently applying plasticised plastics material to the joint.

FIGS. 6 and 7 show the progression of the plastics material layer 90 in the region of the first and second connection portions 76, 80 in greater detail. At the first connection portion 76, the plastics material layer 90 extends from the mould core 64 into the first sleeve 74, where it extends away from the mould core 64 to approach the mould shell 70, and subsequently, in the vicinity of the mould shell 70, extends a distance back towards the second connection portion 80. From the point of view of the canal component 60, the plastics material layer 90 thus extends around the rim of the first opening of the first connection portion 76, in other words the annular projection 76. If an extension direction of the annular projection 76, which extends concentrically around an axial central axis M of the canal 66, is denoted by the reference sign A (FIGS. 5 and 6), the plastics material layer 90 extends around the first connection portion 76 in a direction transverse to the extension direction A. Therefore, in a cross section of the first connection portion 76 shown in the drawings, this results in a substantially U-shaped cross section for the plastics material layer 90. In other words, the plastics material layer 90 is outwardly upended starting from the mould core 64 so as to enclose the first connection portion 76.

In FIG. 6, it can further be seen that a rim 92 arranged in the vicinity of the mould shell 70 is preferably not positioned on the mould shell 70, but rather projects into the mould cavity at a certain distance from the mould shell 70 in such a way that the plastics material layer 90 can be covered by concrete on both sides in the region of the rim 92. In this way, the rim 92 can be effectively integrated into the concrete and attached in the concrete in such a way that even in the event of inclement mounting conditions or a long service life, the rim 92 of the plastics material coating can be reliably prevented from being released. A rim 92 held at a distance from the mould shell 70 in this manner may for example be manufactured by introducing a spacer, for example in the form of an annular strip, which is temporarily fixed in this region on an inner face of the mould shell 70 and to which the plastics material is applied in a plasticised form. Once the plastics material has at least partially cured, the spacer can subsequently be removed such that the desired gap is left between the rim 92 and the mould shell 70.

FIG. 7 shows the progression of the plastics material layer 90 in the region of the second connection portion 80. Starting from the mould core 64, the external wall of which follows the plastics material layer 90, at the second connection portion 80 the plastics material layer 90 extends away from the mould core 64 and follows the progression of the second sleeve 78. In the embodiment, the plastics material layer 90 kinks away outwards at an angle (in this case approximately 90 degrees) and thus approximately forms an L shape in a cross section of the second connection portion 80.

At the rim 94, of the plastics material layer 90, protruding outwards from the mould core 64, the plastics material layer may overlap the seal 89 optionally provided at this point. For example, a particularly reliable and sealed connection is established in that the seal 89 is initially placed on the sleeve 78 and optionally temporarily fixed there, and in a subsequent step plastics material in a plasticised form is applied to the sleeve 78 and to part of the seal 89 as a continuous coating. As a result of the overlap, effective fixing and good sealing between the plastics material layer 90 and the seal 89 are ensured.

Alternatively, direct integration of a seal 89 into the concrete of the connection portion 80 can be omitted, and instead the plastics material layer 90 may substantially cover the entire recess 88 of the second connection portion 80 as a continuous layer, in other words the plastics material layer 90 may extend as far as an outermost axial end of the canal component 60, in other words as far as an axial end face 95 of the second connection portion 80. A seal may subsequently be placed for example on the first connection portion 76 before the adjacent components are joined together such that the seal is subsequently arranged between the first and second connection portions of two canal components which have been joined together, but the entire region which the seal abuts on both sides is completely and generously covered with a plastics material cladding layer.

In a further method step of the method according to the second embodiment, bonding courses are arranged on the plastics material layer 90. For the description of possible bonding courses and variants for providing such bonding courses, reference is made to the description of the first embodiment, which is completely transferable to the second embodiment.

In a further method step of the method according to the second embodiment, the mould core 64 is arranged in the mould shell 70. For example, if a pipe is being manufactured, the mould shell 70 can be drawn coaxially over the mould core 64 along the axial central axis M. Alternatively, the mould shell 70 may be configured in such a way that it can be opened and closed so as to insert the mould core 64. The first and second sleeves 74, 78 may be mounted on the mould core 64 or on the mould shell 70 at the appropriate time as long as they are not formed as a solid unit together with the mould core or mould shell. For example, a variant is conceivable in which the second sleeve 78 is rigidly connected to the mould shell 70 and/or the table 82 and the first sleeve 74 is rigidly connected to the mould core 64 in such a way that, to close the mould 62, the assembly of the mould core 64 and the first sleeve 74 merely has to be introduced concentrically into the mould shell 70 and into the second sleeve 78.

Once the mould 62 has been closed, concrete is introduced into the mould cavity and processed in a manner known per se in a direct demoulding process or in a mould-setting process to form the canal component 60. For a direct demoulding process, a vibration apparatus may be provided on or in the mould core 64 or on the mould shell 70 or else on the table 82, and transfers a vibrational or wobbling movement to the concrete so as to compact the concrete after it is poured in such that demoulding is possible immediately afterwards. In the mould-setting process, vibration apparatuses are not necessary, and the concrete is left at least until it has partially set in the mould pipe cavity in such a way as to make demoulding possible.

During demoulding, the mould core 64 is removed from the plastics material layer 90 which remains to form the plastics material cladding, in particular as a result of the adhesion, reinforced by bonding courses, to the concrete of the canal component 60. For demoulding, the first sleeve 74 and/or the second sleeve 78 are advantageously also removed and the mould shell 70 is removed. The plastics material layer 90 is also separated from the mould 62 (in other words from the first or second sleeve 74, 78) in the region of the first or second sleeve 74, 78 so that the plastics material layer 90 remains on and on top of the concrete of the canal component 60 as a cover layer.

As can be seen in particular in FIGS. 6 and 7, in the illustrated embodiment a canal component 60 comprising a first connection portion 76 and a second connection portion 80 may be manufactured in such a way that two canal components 60 equipped with connection portions of this type can be joined so as to fit together in accordance with the second embodiment in such a way that, at the contact points where the two canal components 60 touch one another at the connection portions thereof, the touch contact is reliably covered by the plastics material layer 90 or by the seal 89 which overlaps the plastics material layer 90. Because the plastics material layer extends around the first connection portion and the second connection portion at least in part, preferably completely, from the inner face 68 of the canal component 60 towards the outside, and a continuous plastics material layer 90 extends from the first connection portion 76 over the inner face 68 as far as the second connection portion 80, a canal which is formed by the described canal components 60 can be clad completely with plastics material and sealed off against the escape of liquid or gases. Undesired contact of liquids or gases of the medium carried in the canal with the concrete of the canal components 60 can be reliably prevented.

In the following, a third embodiment of the invention is described with reference to FIG. 8 to 10. FIG. 9 shows a canal component 100, in this case a pipe, which is made of concrete and has been manufactured in the desired shape in an upstream method. The canal component 100 is positioned separately from other canal components on a processing station and is held by a holding device 102.

The canal component 100 comprises at least one connection portion at which it can be coupled to adjacent components of a canal system. In the illustrated embodiment, the canal component 100 comprises a first connection portion 104 at a first opening of a canal 106 defined by the canal component 100, and comprises a second connection portion 106 at a second opening. The shape of the first and second connection portions 104, 106 may be configured according to the example of the canal component 60 of the second embodiment, reference being made in this regard to the description thereof.

In the method or manufacturing device of the third embodiment, too, the canal component 100 is to be provided with a plastics material layer or inliner layer made of plastics material on an inner wall facing the canal 106 and in the region of the connection portions 104, 106. In the third embodiment, this plastics material layer is applied to a new, at least partially cured concrete body of the canal component 100 in a plasticised form. A polyurea, an epoxy resin, a polyethylene (PE), a polypropylene (PP) or another thermoset material may be used as the material for the plastics material layer 110, polyurea being the preferred material for the reasons explained above. The plastics material may be applied together with a curing agent, it being possible for the plastics material and the curing agent to be mixed prior to the application of the plastics material or else directly at the time of the application of the plastics material, for example using a mixing nozzle.

As regards the various techniques for applying the plastics material, reference is made to the description of the first embodiment. In particular, application by spraying methods is conceivable.

In the illustrated embodiment, the canal component 100 is pipe-shaped and comprises a cylindrical internal wall 108, and in a particularly preferred variant of the invention the plastics material for the plastics material layer 110 is applied by rotational spraying, which is described in the following, using a rotational spraying device 112. The rotational spraying device 112 comprises a first movement arrangement 114, on which a first application arrangement 116 is movably held in such a way that the first application arrangement 116 can move along or in parallel with an axial central axis M of the canal component 100 (central canal axis). The first application arrangement 116 and the movement arrangement 114 can be coupled together by a linear guide known per se so as to make possible movement of the first application arrangement 116 as dictated by an electronic control apparatus 118.

The first application arrangement 116 may comprise a spray head which is rotatable about the axial central axis M or an axis parallel thereto so as to throw a plastics material supplied to the spray head (and optionally mixed with a curing agent) radially outwards with respect to the internal wall 108 of the canal component 100 by means of a centrifugal force, in order to form the plastics material layer 110. The plastics material and optionally the curing agent may be matched to one another in such a way that the plastics material layer 110 cures immediately after the jets strike or after only a short time (for example 10 seconds).

Preferably, the rotational spray device 112 further comprises a second application arrangement 117 which is movably held on a second movement arrangement 120. The second application arrangement 117 may be designed to provide the at least one connection portion 104 or 106 with the plastics material layer 110. The movement arrangement 120 may be designed to move the second application arrangement 117 in a circle about the axial central axis M in such a way that the entire connection portion 104 or 106 can be coated continuously. Preferably, a blast direction of the second application arrangement 117 or a radial distance of the second application arrangement 117 from the axial central axis M may also be adjustable so as to ensure that a seamless plastics material layer 110 can be manufactured which extends outwards from the internal wall 108 over the connection portion 104, 106. This means that the operating regions, in which the first application arrangement 116 and the second application arrangement 117 can apply plastics material to the canal component, preferably overlap.

The first and optionally the second application arrangement and the associated movement arrangements 114, 120 are controlled, preferably fully automatically, in accordance with geometric data regarding the canal component 100 by the control/regulating apparatus 118. After the plastics material layer 110 sets, a canal component 100 is obtained which is cladded completely by a continuous plastics material layer 110 on the internal wall 108 thereof and on at least one of the connection portions 104, 106.

The invention claimed is:

1. A method for manufacturing a concrete canal component, comprising the following steps:

providing an inner mould which forms an internal contour of the concrete canal component facing a canal inner space;

coating the inner mould with a plasticised plastics material;

curing the plasticised plastics material to form a solid plastics material layer;

arranging the inner mould, along with the solid plastics material layer, and a mould shell which forms an external contour of the concrete canal component in such a way that the mould shell encloses the inner mould;

pouring concrete in between the inner mould and the mould shell;

at least partially curing or compacting the concrete; and, demoulding the concrete canal component including the cured plasticised plastics material on the concrete canal component.

2. The method of claim 1, wherein the concrete canal component is a lower shaft part comprising a conduit and wherein the inner mould comprises a conduit moulding body of a foamed plastics material, which forms the conduit.

3. The method of claim 2, wherein the foamed plastics material is expanded polystyrene.

4. The method of claim 1, wherein the concrete canal component comprises a connection portion designed to come into contact with another component, which is to be connected to the concrete canal component, wherein a portion of the inner mould, which forms the connection portion, or a mould sleeve, which forms the connection portion, is also coated with plasticised plastics material.

5. The method of claim 4, wherein a seal is placed the portion of the inner mould forming the connection portion (80) or on the mould sleeve, the plasticised plastics material being applied in such a way that it overlaps or covers the seal.

6. The method of claim 4, wherein the component, which is to be connected to the concrete canal component, is an adjacent canal component.

7. The method of claim 1, wherein bonding courses in the form of grit, sand, granulate, anchoring projections or in the form of a lattice are either applied to the solid plastics material layer or introduced into the plasticised plastics material.

8. The method of claim 1, wherein, prior to coating the inner mould with the plasticised plastics material, the inner mould is coated with a separating medium.

9. A method for manufacturing a concrete canal component, comprising the following steps:

providing an inner mould which forms an internal contour of the concrete canal component which faces a canal inner space;

coating the inner mould with a plasticised plastics material;

coating the inner mould with a separating medium prior to coating the inner mould with the plasticised plastics material;

curing the plasticised plastics material to form a solid plastics material layer, providing a mould shell which forms an external contour of the concrete canal component;

pouring concrete in between the inner mould and the mould shell;

at least partially curing or compacting the concrete; and, demoulding the concrete canal component including the cured plasticised plastics material on the concrete canal component, wherein the concrete canal component comprises at least one of a shaft ring, a shaft cone, or a pipe.

* * * * *